United States Patent [19]

Holz

[11] 4,111,373

[45] Sep. 5, 1978

[54] APPARATUS FOR DEFIBERING CONGLOMERATES OF FIBER IN FIBROUS SUSPENSIONS, ESPECIALLY IN THE PROCESSING OF MIXED WASTE PAPER

[75] Inventor: Emil Holz, Eningen u.A., Fed. Rep. of Germany

[73] Assignee: Hermann Finckh Maschinenfabrik, Fed. Rep. of Germany

[21] Appl. No.: 776,520

[22] Filed: Mar. 11, 1977

[30] Foreign Application Priority Data

Mar. 20, 1976 [DE] Fed. Rep. of Germany ..... 2611886

[51] Int. Cl.[2] ..... B02C 23/36

[52] U.S. Cl. ..... 241/46.11; 209/273

[58] Field of Search ..... 241/46 R, 46.11, 46.17, 241/86, 86.1, 87.1; 209/273, 300, 303, 304, 306

[56] References Cited

U.S. PATENT DOCUMENTS

| | | | |
|---|---|---|---|
| 1,722,874 | 7/1929 | Wells | 209/273 |
| 1,921,750 | 8/1933 | Heinrich et al. | 209/273 |
| 3,138,336 | 6/1964 | Lejeune et al. | 241/73 |
| 3,411,721 | 11/1968 | Delcellier | 241/46 R |

*Primary Examiner*—Granville Y. Custer, Jr.

*Attorney, Agent, or Firm*—Leydig, Voit, Osann, Mayer & Holt, Ltd.

[57] ABSTRACT

An apparatus for defibering conglomerates of fiber in fibrous suspensions, particularly useful with fibrous suspensions of low stock density, comprising a housing having an inlet and outlets for the fibrous suspension, a hollow cylinder within the housing, and a rotor mounted for rotation within the hollow cylinder. The annular space between the hollow cylinder and the rotor comprises a first region to dewater and screen the fibrous suspension and a second region to defiber conglomerates of fiber in the dewatered portion of the fibrous suspension. In a preferred embodiment, the annular space comprises a third region to wash dirt particles from the processed fibrous suspension and also to dilute said suspension to accommodate a further screening operation.

21 Claims, 4 Drawing Figures

APPARATUS FOR DEFIBERING CONGLOMERATES OF FIBER IN FIBROUS SUSPENSIONS, ESPECIALLY IN THE PROCESSING OF MIXED WASTE PAPER

This invention relates to an apparatus for defibering conglomerates of fiber in fibrous suspensions, comprising a housing with an inlet for the fibrous suspension to be processed and containing a horizontal hollow cylinder, at least part of the wall of which is in the form of a screen and in which a rotor is disposed rotatable about a horizontal axis and comprising at its periphery the projections which effect the defibering conglomerates of fiber.

In a known apparatus of this type (DT-AS 1,185,047) the inlet for the fibrous suspension to be processed opens from above in a radial direction approximately above the middle of the rotor into the housing compartment which contains this latter, and a rejected stock outlet leads out of the housing from approximately above the middle of the rotor, but in a tangential direction. Finally, an accepted stock outlet is provided at the lower end of the housing on the outside of a hollow cylinder which is in the form of a screen over a determined circumferential angle.

In the low consistency range (e.g. about 0.5 to 2% of stock density) the known apparatus for defibering conglomerates of fiber operates with low efficiency and is particularly uneconomical. These problems are especially prevalent in the further processing of the rejected stock from pressure screens operating in the low consistency range, since in the re-screening of this rejected stock alone, there is considerable loss of fibre in the form of fibre material which has not been broken down or had the conglomerates defibered and rejected together with the dirt.

The object of the invention is therefore to provide an apparatus which can effectively defiber conglomerates of fiber in the low consistency range and which is particularly suitable for subsequent conglomerate defibering of the rejected stock of those pressure screens which operate in the low consistency range. This object is attained according to the invention through provision of the inlet is in the region of one of the rotor ends, with a first region of the rotor adjacent to this rotor end being surrounded by a first annular region of the hollow cylinder wall at least the lower portion of which which is in the form of a screen, and a second region of the rotor lying on that side of the first rotor region further from the inlet carrying the projections which effect the conglomerate defibering. In such an apparatus the fibrous suspension to be processed is firstly drained, i.e. concentrated, and only then has its conglomerates defibered, so that the conglomerate defibering process may be carried out economically with good efficiency. As the fibrous suspension to be processed is set into rapid circulation in the annular compartment between the first rotor region and first annular region of the hollow cylinder wall by a correspondingly high rotor speed, the apparatus according to the invention removes water particularly effectively, the dimensions of the apparatus and the rotor speed being especially chosen such that the fibrous suspension is firstly concentrated to approximately 3 to 6% of stock density before it progresses along the rotor into the conglomerate defibering region surrounding the second rotor region.

It is obviously not necessary for the rotor to be disposed completely in the hollow cylinder, and it may project therefrom in an axial direction. Moreover, the previously given definition of the invention is not to be understood in the sense that the inlet for the fibrous suspension to be processed must of necessity be disposed adjacent to the rotor, although this is the case in a preferred embodiment of the apparatus according to the invention. It would also be possible for the inlet to open above the rotor into a corresponding opening in the hollow cylinder.

The fibrous suspension with its conglomerates defibered may be fed to a special re-screening. However one advantageous embodiment of the apparatus according to the invention is provided with a stationary horizontal screen basket surrounding a third rotor region lying on that side of the second rotor region further from the inlet. The fibrous suspension then flows on its way along the rotor from the conglomerate defibering region into a third region in which it may be re-screened. It is then desirable for a dilution water inlet to open in the region of the third rotor region in order to reduce the stock density for re-screening and at the same time wash dirt particles from the fibrous suspension.

The conglomerate defibering region may be formed in the several ways. One advantageous approach is to surround the second rotor region by a second annular region of the hollow cylinder, which is in the form of a screen or is provided with inwardly extending projections. In this particular case, the projections of the second rotor region and the second annular region of the hollow cylinder are in the form of circumferentially spaced axially extending ribs.

In order to set into circulation only the minimum volume of the fibrous suspension to be processed, and thereby of reduce the energy requirement, it is recommended to use an enclosed rotor. It would also be acceptable for the rotor to include a central inlet opening at its inlet end and outlet openings opposite the first annular region of the hollow cylinder wall.

For effective water removal, it is particularly recommended that the apparatus be constructed so that the annular compartment between the first rotor region and first annular region of the hollow cylinder narrows as the distance from the rotor inlet end increases. This may be accomplished by reducing the diameter of the rotor along the first rotor region in the direction of the inlet. This provision, i.e. the narrowing of the annular compartment along the rotor, also allows particularly effective conglomerate defibering.

In order to provide a sufficiently large volume in that rotor region in which re-screening takes place and dirt particles are washed out such that the fibres are not immediately carried over into a neighbouring rejected stock compartment by the feed of the dilution water, it is desirable for the rotor diameter to decrease along the third rotor region in the direction of the rotor end, i.e. for the rotor to taper in the direction of that end adjacent to the rejected stock compartment. The same effect could also be attained by making the screen basket surrounding the third rotor region widen conically in the direction of the rejected stock compartment, or making the hollow cylinder surrounding the rotor comprise a stepped portion in the region of the third rotor region.

In a preferred embodiment of the apparatus according to the invention, the first and/or third rotor region carries projections, especially of strip form, for setting the fibrous suspension into circulation. Through employment of such means, the fibrous suspension may be far more effectively accelerated than if the rotor comprised a flat surface. High circulation speeds for the fibrous suspension in the water removal region and in the region in which re-screening takes place and dirt is washed out, not only increase the effectiveness of these processes but also prevent the fibrous suspension flowing too rapidly along the rotor in the axial direction such that good fibres reach the rejected stock compartment.

It is recommended that the inlet for the fibrous suspension to be processed opens from above, particularly in a radial or tangential direction, into that part of the housing containing the rotor, and that the fibrous suspension be fed substantially without pressure. For such an apparatus operating without pressure, little energy is required, Moreover, if the fibrous suspension to be processed were to be fed under pressure, the suspension would pass the along rotor at an undesirably fast speed.

If the apparatus according to the invention is connected after a upstream screening device, it should be noted whether this screening device comprises holes or slots. If it comprises holes, it is recommended that the screen apertures in the first annular region of the hollow cylinder are in the form of slots, and vice versa. It is advantageous for the screen apertures in the first annular region of the hollow cylinder to be either holes with a diameter of about 1 mm, or slots with a width of about 0.2 to 0.5 mm.

The invention therefore provides an apparatus which, with low energy consumption and particularly effectively, removes water or concentrates, then defibres conglomerates of fibers, and finally washes out dirt particles and screens.

Further characteristics, details and advantages of the invention will be evident from the accompanying claims and/or the description given hereinafter of a preferred embodiment of the apparatus according to the invention shown in the accompanying drawing in which:

Figure 1:
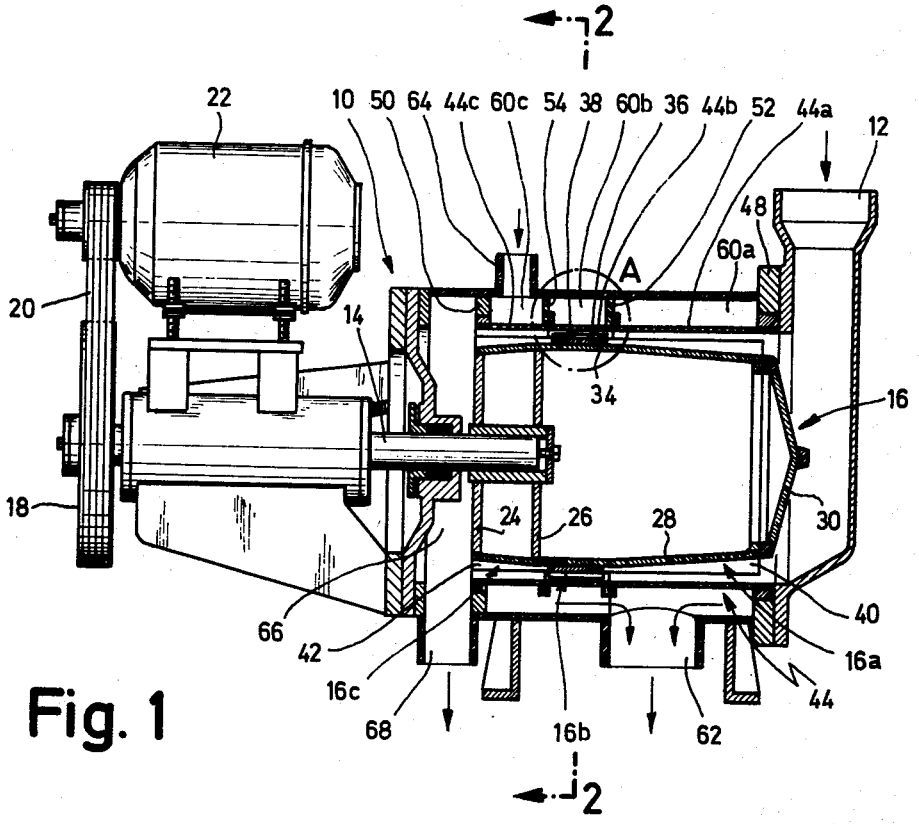
FIG. 1 is an axial section on a vertical plane through a first embodiment of the apparatus according to the invention.
Figure 2:
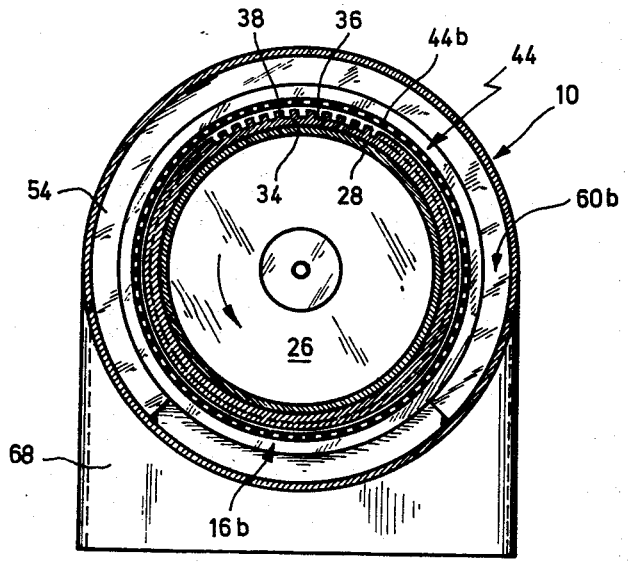
FIG. 2 is a section through this apparatus on the line 2—2 of FIG. 1.
Figure 3:
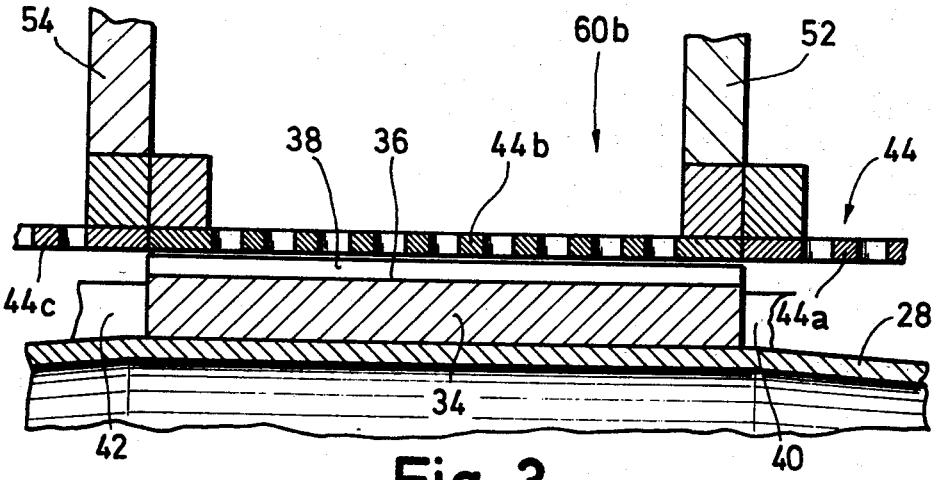
FIG. 3 is a view of the detail indicated by A in FIG. 1, but to a larger scale.

The apparatus shown in FIGS. 1 to 3 comprises a multi-part housing indicated overall by 10, containing at one end an upward facing nozzle forming an inlet 12 for the fibrous suspension to be processed. At the other end a horizontally extending shaft 14 is rotatably supported in the housing 10 and carries at one end a rotor generally indicated as 16 and at its other end a pulley 18, the rotor being driven via this latter and via the drive belt 20 by an electric motor 22.

Two support discs 24 and 26 are fixed on the shaft 14 to support an approximately barrel shaped rotor casing 28, on which a conical cover 30 is fixed to close the rotor at the inlet end, while the support disc 24 closes the rotor at the other end. The barrel shape of the rotor 16 comes about because the casing 28 is of circular cylindrical form in its middle portion and of truncated conical form at its ends, so that it defines a first truncated conical rotor region **16*a* at the end corresponding to the inlet 12, followed by a second circular cylindrical rotor region 16*b* and finally a third truncated conical rotor region 16*c***.

As can be seen from FIGS. 1 and FIG. 2, the second rotor region **16*b* carries a ring 34 which comprises on its periphery longitudinal ribs 38 separated from each other by grooves 36 extending in an axial direction. Strips 40 and 42** to impart rotation to the fibrous suspension, adjoin with this ring on both sides, and extend in an axial direction.

The rotor 16 disposed centrally in the housing 10 rotates in a hollow cylinder indicated overall by 44 and held concentrically in the housing. In the preferred embodiment this hollow cylinder is shown in FIGS. 1 to 3 in the form of a stationary screen basket. Corresponding to the three rotor regions, the hollow cylinder also comprises a first, a second and a third annular region **44*a*, 44*b* and 44*c*, defined by the rings 48 and 50 which hold the hollow cylinder and by approximately C-shaped ring segments 52 and 54. These rings and ring segments also bound three successive annular compartments 60*a*, 60*b* and 60*c*, lying between the hollow cylinder 44 and the circumferential wall of the housing 10. It should be noted that in the lower part of the apparatus, because of the C-shape of the ring segments 52 and 54, the annular compartments 60*a*, 60*b* and 60*c*** are connected together.

The circumferential wall of the housing 10 comprises below the first annular region **44*a* of the hollow cylinder 44 a so-called accepted stock outlet 62, while in the region of the third annular region 44*c* there is an upper nozzle 64 in the circumferential wall of the housing 10** to form a dilution water inlet.

The housing 10 comprises adjacent to that end of the rotor 16 further from the inlet 12 a so-called rejected stock compartment 66, with a rejected stock outlet 68 in the bottom thereof.

According to the invention, because the inlet 12 opens from above into the housing compartment containing the rotor 16, it is not necessary to feed the fibrous suspension to be processed into the apparatus under pressure. Generally this fibrous suspension comes from the rejected stock outlet of a previous pressure screen operating in the low consistency range, so that it comprises a relatively low stock density e.g. between 0.5 and 2%. This fibrous suspension is effectively drained in a water removal region between the first rotor region **16*a* and first annular region 44*a* of the screen basket or hollow cylinder 44, as the suspension is set into strong circulation by the acceleration strips 40 of the rotor 16 which rotates at high speed. The peripheral speed of the rotor, the length of the first rotor region and first annular region and the width of the annular compartment therebetween are desirably so determined that the fibrous suspension is concentrated to such an extent that when it leaves the water removal region it has a stock density of about 3 to 6%. The apertures in the first annular region 44*a* of the hollow cylinder 44** are determined according to the apertures in the screen basket of the upstream pressure screen, and these are desirably holes of about 1 to 1.2 mm diameter or narrow slots of about 0.3 to 0.4 mm width.

The concentrated fibrous suspension then reaches the conglomerate defibering region formed by the ring 34 and the second annular region **44*b* of the hollow cylinder 44. In this region the annular compartment between the rotor and hollow cylinder is particularly narrow, and conglomerates or fibre groupings are effectively broken down by the longitudinal ribs 38 and the grooves 36**. Such breakdown could not be accomplished without the previous concentration of the fibrous suspension.

The fibrous suspension with the conglomerated defibered then arrives in a washing or screening region between the third rotor region 16c and the third annular region 44c. Because of the barrel shape of the rotor there is a sufficiently large volume available in this washing or screening region to allow dirt particles to be washed out with the dilution water fed through the nozzle 64 and to be separated from good fibres, and to provide the optimum stock density for further screening. Because of the acceleration strips 42, the fibrous suspension in the washing or screening region is accelerated to such a high peripheral speed that the fed dilution water does not immediately sweep the fibrous suspension into the rejected stock compartment 66. The hollow cylinder 44 also contains fine holes or slots in the third annular region 44c.

The accepted stock flowing through the apertures in the annular regions 44a, 44b and 44c joins together in the lower part of the housing 10 and flows out through the accepted stock outlet 62. The dirt washed out reaches the rejected stock compartment 66 and is drawn off through the rejected stock outlet 68.

Figure 4:
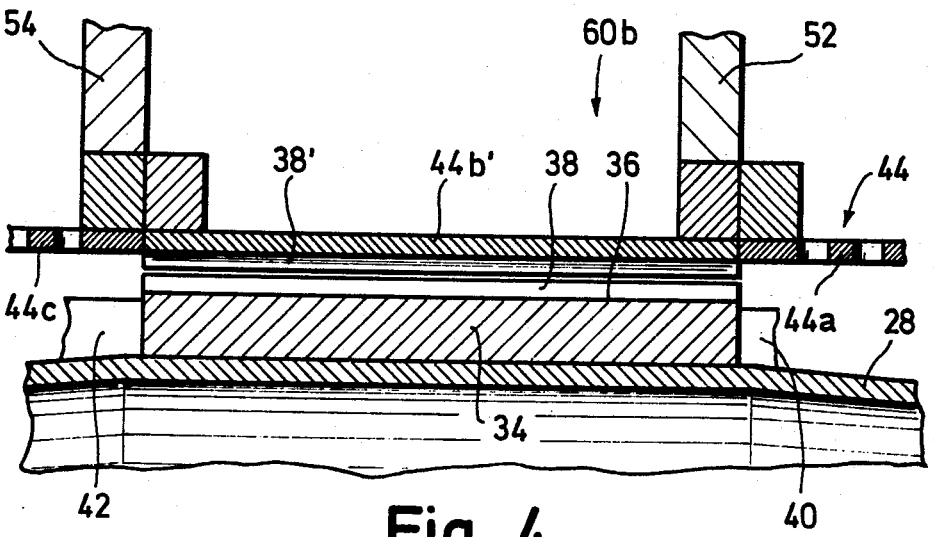
FIG. 4 is a modified embodiment of the detail corresponding to FIG. 3.

In the modified embodiment shown in FIG. 4, the second annular region 44b' of the hollow cylinder 44 has no apertures, so that all the fibrous suspension reaching the speck removal region flows further into the washing or screening region. In this second embodiment, the second annular region carries longitudinal ribs 38' extending in an axial direction and projecting inwards, and between which there lie corresponding grooves. Speck elimination in the fibrous suspension thus takes place between the longitudinal ribs 38 of the rotor and the longitudinal ribs 38' of the hollow cylinder.

The first annular region 44a can also be used for screening, with simultaneous water removal. Hence the apparatus according to the invention could also rescreen the rejected stock from an upstream screening device and then defibre conglomerates of fiber.

I claim:

1. An apparatus for reducing conglomerates of fibers in fibrous suspensions, particularly useful with fibrous suspension of low stock density, comprising:

a housing, said housing having a first inlet for the fibrous suspension to be processed, a second inlet for dilution water, at least a first outlet for the processed fibrous suspension and a second outlet for the rejected part of the suspension;

a rotor mounted for rotation within said housing, said rotor having at least three regions along the direction of the rotor axis;

a first hollow cylinder surrounding the first of said rotor regions, at least the lower portion of said first cylinder being provided with perforations in the form of a screen, the outer surface of said first cylinder being in flow communication with said first outlet, the inner surface of said first cylinder and said first rotor region forming a first annular space into which the fibrous suspension entering through said first housing inlet flows and is set into rotation to centrifugally remove excess water and part of the fibers therefrom through said screen;

a second hollow cylinder surrounding the second of said rotor regions, the inner surface of said second hollow cylinder and said second rotor region forming a second annular space into which the remainder of said fibrous suspension with said fiber conglomerates therein flows, said second rotor region having means to effect the defibering of fiber conglomerates;

a stationary cylindrical screen surrounding the third of said rotor regions, the outer surface of said stationary screen being in flow communication with said first outlet for the processed suspension, the inner surface of said stationary cylindrical screen and said third rotor region forming a third annular space, said third annular space being in flow communication with said second annular space, said second inlet for dilution water and said second outlet, said dilution water serving to dilute the fibrous suspension in said third annular space to facilitate the passage of said fibrous suspension through said stationary cylindrical screen and into said first outlet and also serving to wash dirt particles from said fibrous suspension and into said second outlet.

2. In the apparatus of claim 1, the axes of said rotor, said cylinders and said cylindrical screen being mounted horizontally.

3. In the apparatus of claim 1, said first inlet being provided at one end of said housing adjacent to said first rotor region with said second rotor region being disposed on that side of the first rotor region further from said first inlet.

4. In the apparatus of claim 1, the diameter of said rotor in said third rotor region decreasing away from said second rotor region.

5. In the apparatus of claim 1, said second cylinder having perforations in the form of a screen, the outer surface of said second cylinder being in flow communication with said first outlet.

6. In the apparatus of claim 1, said second cylinder having perforations in the form of a screen, the outer surface of said second cylinder being in flow communication with said first outlet for processed suspension.

7. In the apparatus of claim 1, said second cylinder further comprising projections extending inwardly into said second annular space.

8. In the apparatus of claim 1, said rotor being completely closed on all sides.

9. In the apparatus of claim 1, the diameter of said rotor in said first rotor region increasing towards said second rotor region.

10. In the apparatus of claim 1, said means to effect the defibering of fiber conglomerates comprising axially arranged, circumferentially spaced ribs.

11. In the apparatus of claim 1, the perforations of said first cylinder being holes with a diameter of substantially 1 mm.

12. In the apparatus of claim 1, the perforations of said first cylinder being slots with a width between 0.2 and 0.5 mm.

13. In the apparatus of claim 1, the third rotor region further comprising means to impart rotation to said fibrous suspension.

14. In the apparatus of claim 13, said means to impart rotation to said fibrous suspension comprising axially arranged, circumferentially spaced ribs.

15. In the apparatus of claim 1, the first rotor region further comprising means to impart rotation to said fibrous suspension.

16. In the apparatus of claim 15, said means to impart rotation to said fibrous suspension comprising axially arranged, circumferentially spaced ribs.

17. In the apparatus of claim 1, said housing further comprising a compartment disposed adjacent to that end of the rotor opposite to the first rotor region and including said second outlet, said compartment receiving the rejected portion of the fibrous suspension from said third annular space.

18. In the apparatus of claim 17, said second outlet opening being in the lower part of said compartment.

19. In the apparatus of claim 1, said first inlet in said housing being directed downwardly to permit said fibrous suspension to be processed to be fed into the apparatus by gravity without pressure.

20. In the apparatus of claim 19, said first inlet in said housing being arranged radially relative to said rotor.

21. In the apparatus of claim 19, said first inlet in said housing being arranged tangentially relative to said rotor.

* * * * *